US011376467B2

(12) United States Patent
Viglione

(10) Patent No.: US 11,376,467 B2
(45) Date of Patent: Jul. 5, 2022

(54) EXERCISE DEVICE

(71) Applicant: QUANTUM INNOVATION AUSTRALIA PTY LTD, Parramatta (AU)

(72) Inventor: Dean Viglione, Wentworth Point (AU)

(73) Assignee: Quantum Innovation Australia Pty Ltd, Parramatta (AU)

( * ) Notice: Subject to any disclaimer, the term of this patent is extended or adjusted under 35 U.S.C. 154(b) by 98 days.

(21) Appl. No.: 16/651,374

(22) PCT Filed: Sep. 27, 2018

(86) PCT No.: PCT/AU2018/051057

§ 371 (c)(1),
(2) Date: Mar. 27, 2020

(87) PCT Pub. No.: WO2019/060958

PCT Pub. Date: Apr. 4, 2019

(65) Prior Publication Data

US 2020/0261766 A1 Aug. 20, 2020

(30) Foreign Application Priority Data

Sep. 28, 2017 (AU) ..... 2017903948

(51) Int. Cl.
*A63B 23/14* (2006.01)
*A63B 21/00* (2006.01)
(Continued)

(52) U.S. Cl.
CPC ..... *A63B 23/14* (2013.01); *A63B 21/0442* (2013.01); *A63B 21/0552* (2013.01);
(Continued)

(58) Field of Classification Search
CPC . A63B 23/14; A63B 21/4035; A63B 21/4045; A63B 21/4047; A63B 21/4049;
(Continued)

(56) References Cited

U.S. PATENT DOCUMENTS 4,822,035 A * 4/1989 Jennings ..... A63B 21/0724 482/106
5,407,405 A 4/1995 Oren
(Continued)

FOREIGN PATENT DOCUMENTS

CA 2675186 2/2011

OTHER PUBLICATIONS

Written Opinion and International Search Report dated Nov. 8, 2018, issued in PCT Patent Application No. PCT/AU2018/051057, 4 pages.

*Primary Examiner* — Andrew S Lo
(74) *Attorney, Agent, or Firm* — Thomas M. Joseph, Esq

(57) ABSTRACT

An exercise device includes a device frame for operative coupling to a load during a strength training exercise. The device frame defines a device track and a handle assembly for operative attachment to the device frame. The handle assembly including a hand grip to be held by a user during the strength training exercise, and a track follower formation attached to the hand grip. The track follower formation is operatively adapted for movement along the device track during the strength training exercise.

15 Claims, 4 Drawing Sheets

(51) Int. Cl.
*A63B 21/04* (2006.01)
*A63B 23/035* (2006.01)
*A63B 21/055* (2006.01)

(52) U.S. Cl.
CPC ..... *A63B 21/4035* (2015.10); *A63B 21/4045* (2015.10); *A63B 21/4047* (2015.10); *A63B 21/4049* (2015.10); *A63B 23/03541* (2013.01)

(58) Field of Classification Search
CPC ..... A63B 21/0442; A63B 21/0552; A63B 23/03541; A63B 21/055; A63B 21/00
See application file for complete search history.

(56) References Cited

U.S. PATENT DOCUMENTS 5,718,654 A 2/1998 Kennedy
6,652,420 B2 11/2003 Chen
7,094,186 B2 * 8/2006 Diakonov ..... A63B 21/0728 482/104
7,862,486 B1 * 1/2011 Watson ..... A63B 21/4035 482/106
8,360,941 B2 1/2013 Kristiansen
8,715,147 B2 * 5/2014 Collins ..... A63B 21/4035 482/126
8,821,355 B2 9/2014 Daniel
8,845,500 B2 * 9/2014 Huang ..... A63B 21/015 482/122
9,855,456 B2 * 1/2018 Dorsey ..... A63B 21/4035
10,029,140 B2 * 7/2018 Douglass ..... A63B 23/03533
10,695,604 B2 * 6/2020 Porterfield ..... A63B 21/055
10,888,731 B2 * 1/2021 Olmstead ..... A63B 21/0724
11,040,241 B1 * 6/2021 Fiocchi ..... A63B 23/03508
2005/0202942 A1 * 9/2005 De Lano ..... A63B 21/0724 482/107
2008/0176723 A1 7/2008 Johnson
2010/0113234 A1 5/2010 Kristiansen
2015/0196795 A1 * 7/2015 Kristiansen ..... A63B 21/4049 482/139
2017/0282000 A1 * 10/2017 Dorsey ..... A63B 21/4013
2019/0126092 A1 * 5/2019 Miller ..... A63B 21/4035

* cited by examiner

EXERCISE DEVICE

CROSS REFERENCE TO RELATED APPLICATIONS

The present application is a U.S. national stage application of PCT International Application No. PCT/AU2018/051057, filed Sep. 27, 2018, and published as PCT Publication WO/2019/060958 on Apr. 4, 2019, which claims priority to Australian Application No. AU 2017903948, filed on Sep. 28, 2017. The disclosures of all the foregoing applications are hereby incorporated by reference in their entirety into the present application.

FIELD

The invention concerns an exercise device, in particular but not exclusively, an exercise device for strength/resistance training.

BACKGROUND

Strength training (also referred to as resistance training) is the use of resistance to effect muscular contraction to build strength, anaerobic endurance and size of skeletal muscles. Strength training is based on the principle that muscles of the body will work to overcome a resistance force when required to do so. Athletes engaged in a repeated and consistent resistance training program will experience strengthening in those muscles being exercised. A well-rounded fitness program includes resistance training to improve bone, joint function, bone density, muscle, tendon and ligament strength as well as aerobic exercise to improve heart and lung fitness, flexibility and balance exercises.

Various types of exercise equipment are known for use in resistance training. Many such resistance training equipment include pull handles connected to cables, weights or other forms of resistance. In use, a person will grip the handle to cause some movement against a resistive force, for example the force required to lift an amount of weights. One drawback of conventional handles is the fact that they normally have a fixed point of attachment, therefor offering a limited range of movement which do not account for the rotation of a user's hand or wrist as the user's hand extends through the range of motions required to perform a particular type of exercise. Such limitation may result in injury due to unnatural stresses imparted to a user's joints, tendons and/or ligaments.

Published US patent application 2010/0113234 seeks to address the above problems by providing an ergonomically designed pull handle which avoids unnatural stresses in a user's body. The pull handle of that US application includes one or more axes of rotation in the pull handle.

Object

It is an object of the present invention to provide an alternative exercise device for use in strength/resistance training.

SUMMARY

According to a first aspect there is disclosed herein an exercise device for strength training, the exercise device including:

a device frame for operative coupling to a load during a strength training exercise, the device frame defining a device track; and a handle assembly for operative attachment to the device frame, the handle assembly including (i) a hand grip to be held by a user during the strength training exercise, and (ii) a track follower formation attached to the hand grip, the track follower formation operatively adapted for movement along the device track during the strength training exercise.

Preferably the device frame includes at least one connector for operative coupling to an elongate body.

Preferably the at least one connector includes a flange having an aperture to facilitate attachment to the elongate body.

Preferably the device frame includes a plurality of connectors.

Preferably the device frame includes a first frame member and an opposing second frame member.

Preferably the first frame member is releasably secured to the second frame member.

Preferably the first frame member is releasably secured to the second frame member with a plurality of fasteners.

Preferably each fastener includes a nut and a bolt.

Preferably the first frame member and the second frame member are of identical construction.

Preferably the handle grip is elongate and longitudinally extends along a handle grip axis, the handle grip being attached to the track follower so as to be adapted for pivotal motion about the handle grip axis.

Preferably the device frame defines a curved device track.

Preferably the track follower is curved as to be complemental to the curved device track.

Preferably the handle assembly is adapted to undergo rotational movement as the track follower is moved along the device track.

Preferably the handle assembly includes a device track engagement formation adapted for engaging a complemental handle assembly engagement formation of the device track.

Preferably the device track engagement formation includes at least one groove and the handle assembly includes at least one outwardly extending protrusion adapted to be received within the at least one groove.

Preferably the device frame defines a connector track.

Preferably the connector track includes a connector track base and a connector slot formed within the device frame.

Preferably the flange of the at least one connector is adapted to pass through the connector slot.

Preferably the at least one connector includes a connector body wherein the flange outwardly extends from the connector body, the connector body adapted to be secured between the connector track base and the connector slot with the flange passing through the connector slot, wherein the connector flange is adapted to be moved along the connector slot.

Preferably the at least one connector is a first connector and the device frame includes two connectors, wherein the flange of each connector passes through the connector slot and wherein each connector flange is adapted to be moved along the connector slot.

In an embodiment (i) the device track is a first device track and the exercise device includes a second device track, and (ii) the handle assembly is a first handle assembly and the exercise device includes a second handle assembly.

In a second aspect there is disclosed herein an exercise device for strength training, the exercise device including:

a device frame for operative coupling to a load during a strength training exercise, the device frame defining a device track;

a handle assembly for operative attachment to the device frame, the handle assembly including (i) a hand grip to be held by a user during the strength training exercise, and (ii) a track follower formation attached to the hand grip, the track follower formation operatively adapted for movement along the device track during the strength training exercise; and a resilient body operatively coupled to the device frame.

BRIEF DESCRIPTION OF THE DRAWINGS

Preferred embodiments of the invention will be described hereinafter, by way of examples only, with reference to the accompany drawings, wherein.

DESCRIPTION OF PREFERRED EMBODIMENTS

Figure 1:
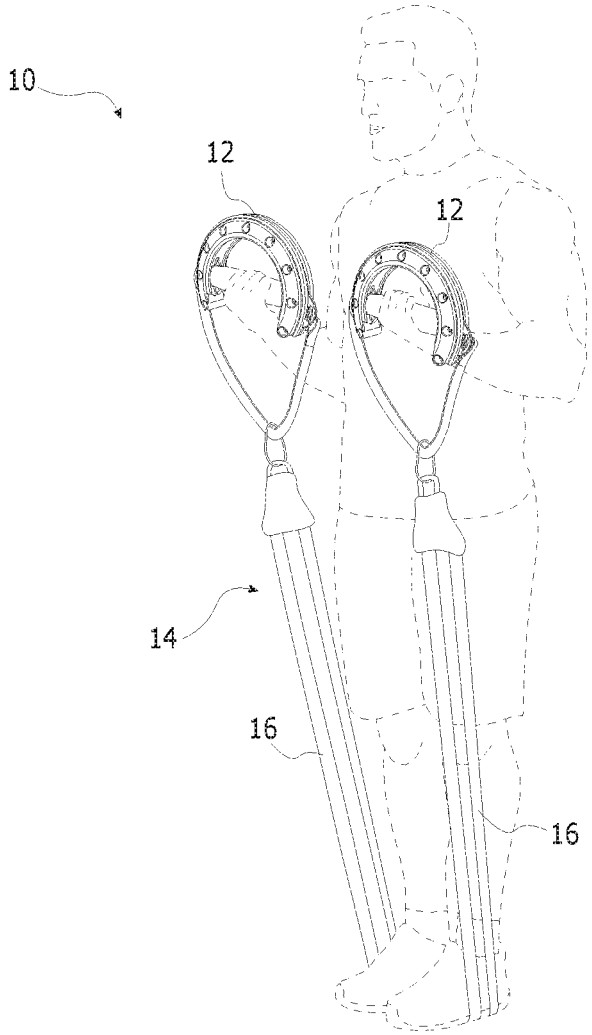
FIG. 1 is a schematic perspective view of a user employing a first embodiment exercise device during a strength training exercise.

FIG. 1 shows a user employing an embodiment exercise device, generally indicated with the reference numeral 10, to perform a strength training exercise. The exercise device 10 includes two device frames 12 which are connected to a resilient body 14. The resilient body 14 includes a plurality of resilient bands 16. By having the user stand on the resilient bands 16, the device frames 12 are coupled to a load when the resilient bands 16 are stretched. As a result, the muscles of the user's body are caused to work to overcome the resistance force created by the stretched resilient bands 16. During this strength training exercise muscle fibres of the user are broken down. In the days following the exercise the fibres will repair and grow stronger to meet demands placed thereon when next using the exercise device 10.

Figure 2:
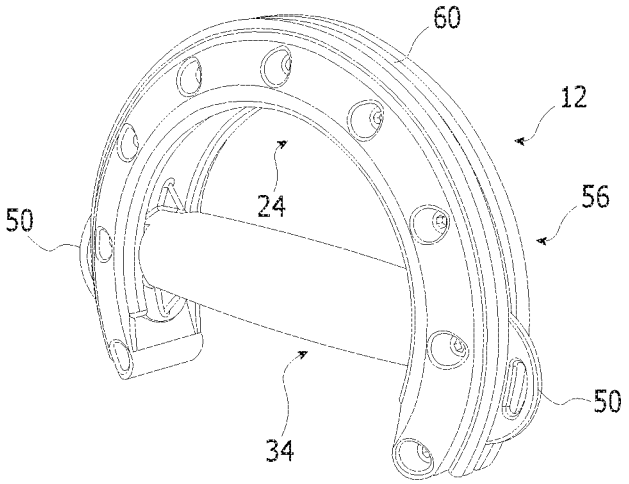
FIG. 2 is a schematic perspective view of the embodiment exercise device of FIG. 1 without a resilient body.
Figure 3:
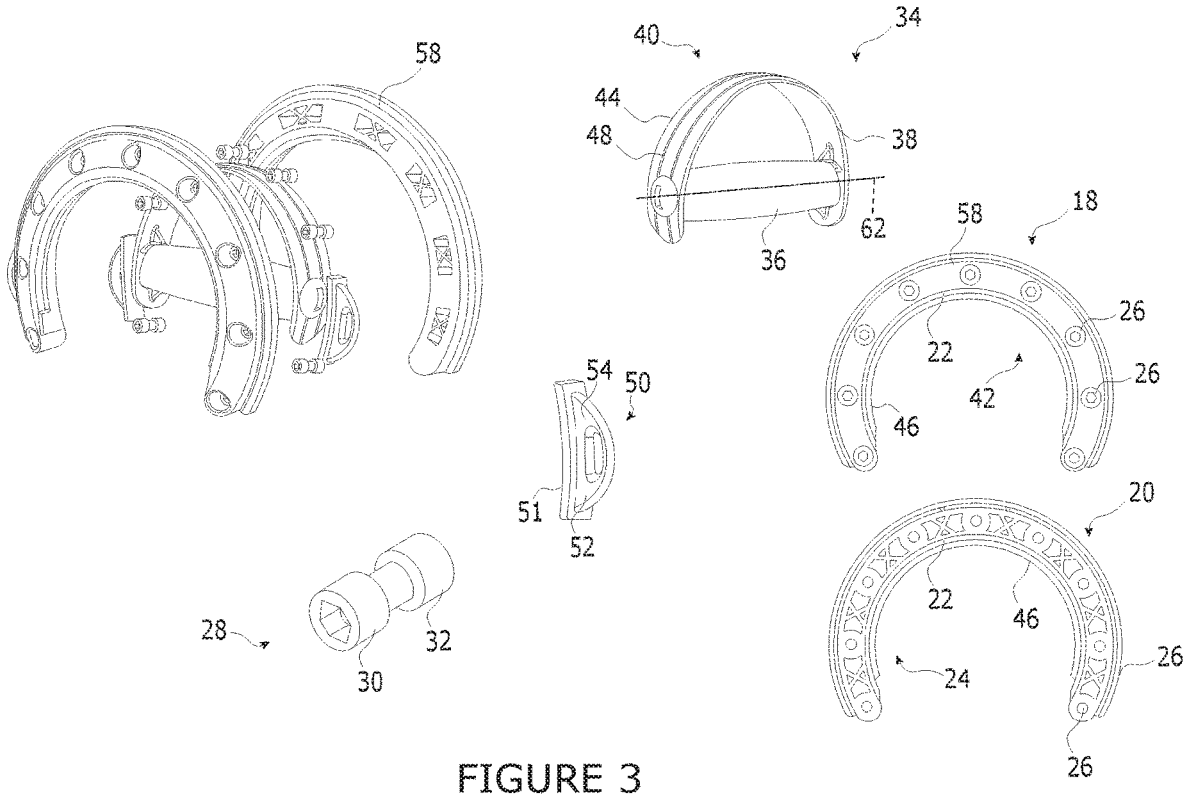
FIG. 3 is a schematic exploded perspective view of the exercise device of FIG. 2.

Referring to FIGS. 2 and 3, the device frame 12 frame includes a first frame member 18 and an opposing second frame member 20 which are releasably secured to each other. The first and second frame members 18, 20 each includes a track portion 22 which co-operate to define a device track 24 when the first and second frame members 18, 20 are secured to one another. The first and second frame members 18, 20 are of identical construction and can be aligned so that fastener openings 26 of the first and second frame members are located in register so as to be secured with fasteners 28. In this embodiment the fasteners 28 each include a bolt 30 and nut 32.

The exercise device 10 further includes a handle assembly 34 for operative attachment to the device frame 12. The handle assembly 34 includes a hand grip 36 held by a user during a strength training exercise. The handle assembly 34 further includes a track follower formation 38 attached to the hand grip 30. The track follower formation 38 is operatively adapted for movement along the device track 24 during the strength training exercise.

Figure 4:
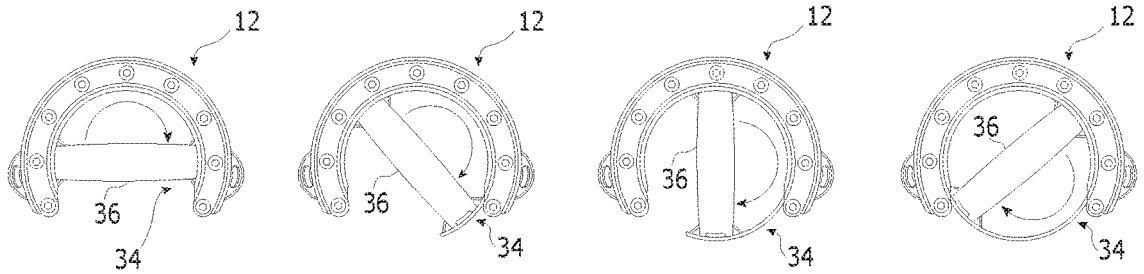
FIG. 4 is a schematic representation of different positions of a handle assembly of the exercise device of FIG. 2.

As shown, the device frame 12 defines a curved device track 24. The track follower formation 38 is curved so as to be complemental to the curved device track 24. The handle assembly 34 is adapted to undergo rotational/pivotal movement as the track follower formation 38 is moved along the device track 24. The rotational/pivotal movement of the handle assembly 34 is illustrated in FIG. 4.

The handle assembly 34 includes a device track engagement formation 40 adapted for engaging a complemental handle assembly engagement formation 42 of the device track 24. The device track engagement formation 40 includes a number of grooves 44 and the handle assembly 34 includes a number of outwardly extending protrusions 46 adapted to be received within the grooves 44. The device track engagement formation 40 also includes a number of outwardly extending protrusions 48 and the handle assembly 34 includes a number of non-illustrated grooves for receiving the protrusions 48.

The device frame 12 includes two connectors 50 which are operatively adapted to couple to an elongate body, in this embodiment the resilient body 14. Each connector 50 includes a connector body 51 and a connector flange 52 outwardly extending from the connector body 51. The connector flange 52 defines an aperture 54 to facilitate attachment to the resilient body 14.

Figure 5:
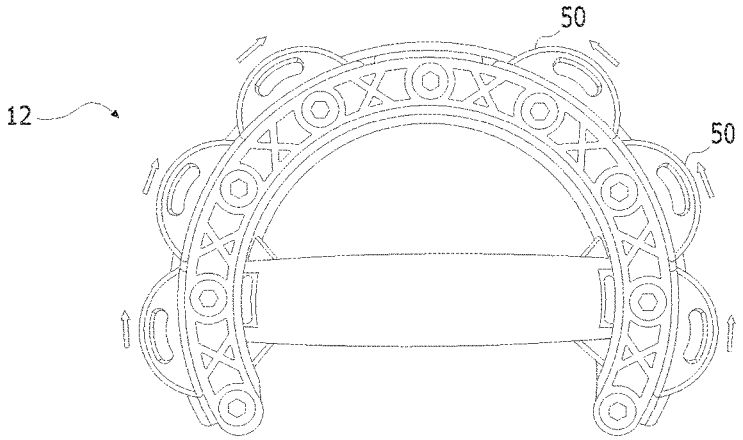
FIG. 5 is a schematic representation of different positions of a connector of the exercise device frame of FIG. 2.

The device frame 12 defines a connector track 56 which includes a connector track base 58 and a connector slot 60 formed within the device frame 12. The dimensions of the connector flange 52 and the connector slot 60 is such that the flange 52 is adapted to pass through the connector slot 60. Furthermore, the dimensions of the connector body 51 is such that the connector body 51 is adapted to be secured between the connector track base 58 and the connector slot 60. The connector flange 52 is adapted to be moved along the connector slot 60 so that the connector 50 can be moved around the device frame 12 as shown in FIG. 5. The purpose of the movable connectors 50 is to provide a user with the ability to change direction of the device frame 12 orientation when the user is required to do a pull forward to the chest exercise, the device frame 12 does not get in the way of the user's wrist.

Figure 6:
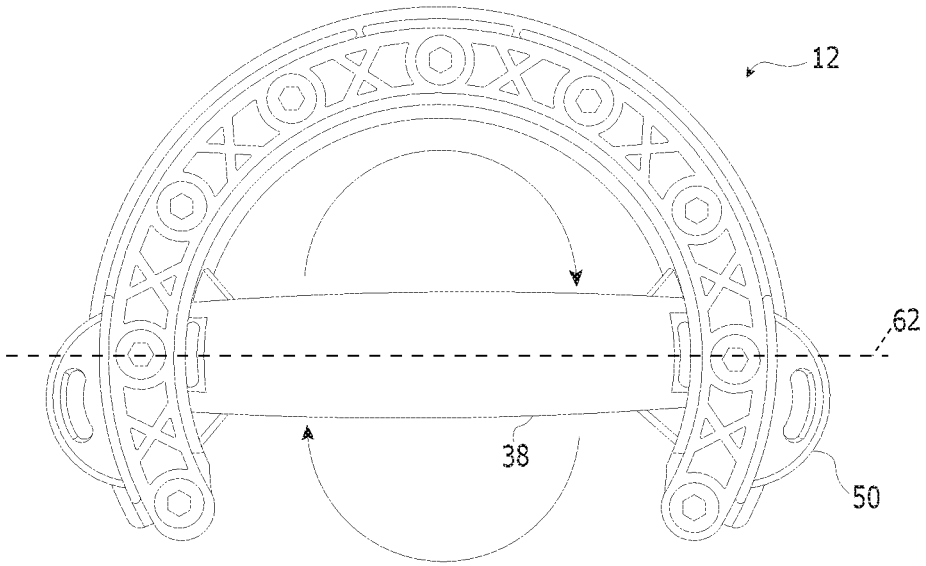
FIG. 6 is a schematic cross-sectional view of the handle assembly illustrating pivotal movement of a grip handle about a longitudinal grip handle axis.

Referring to FIG. 3 the handle grip 36 is elongate and longitudinally extends along a handle grip axis 62. The handle grip 36 is attached to the track follower formation 38 so as to be adapted for pivotal motion about the handle grip axis 62. This pivotal movement is illustrated in FIG. 6.

Figure 7:
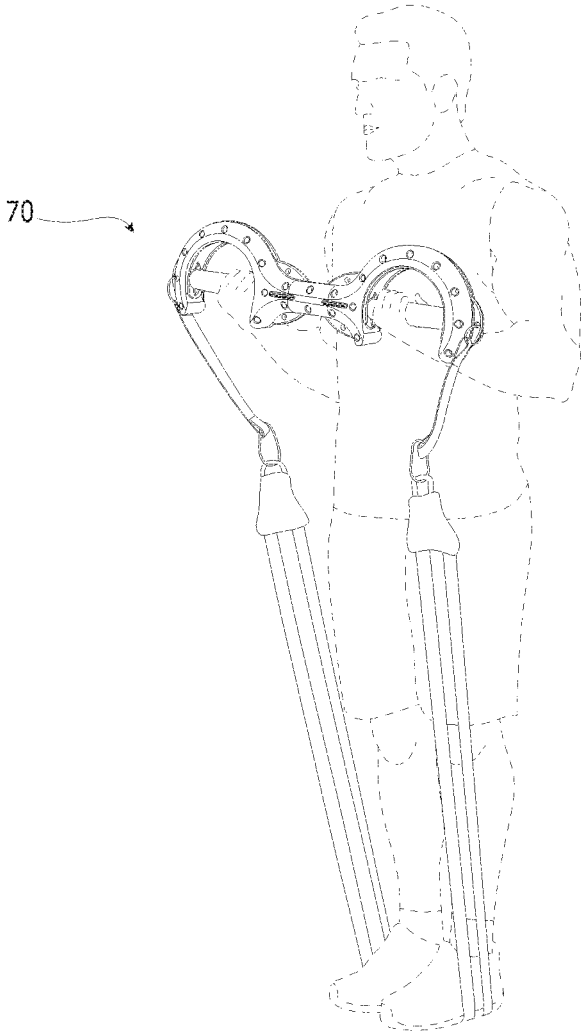
FIG. 7 is a schematic perspective view of a user employing a second embodiment exercise device during a strength training exercise.
Figure 8:
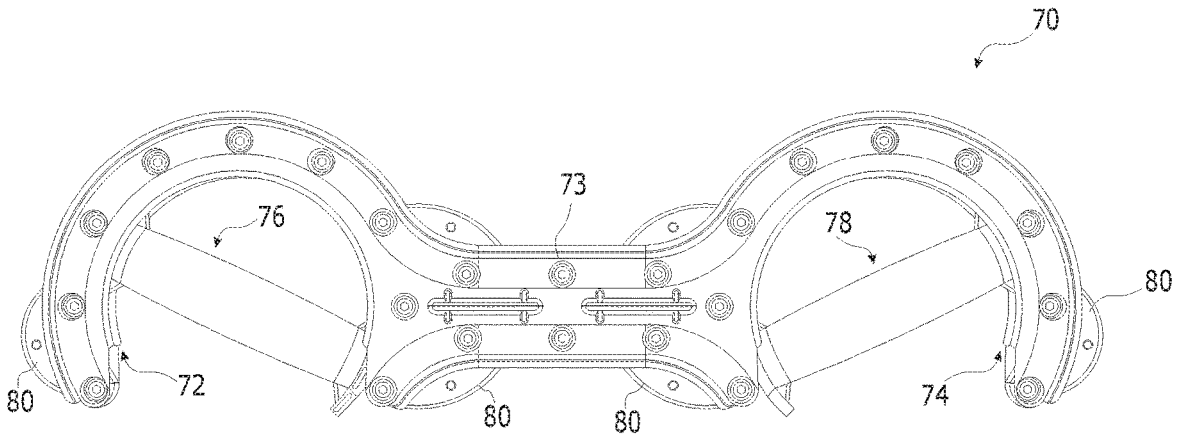
FIG. 8 is a schematic front view of exercise device of FIG. 7.
Figure 9:
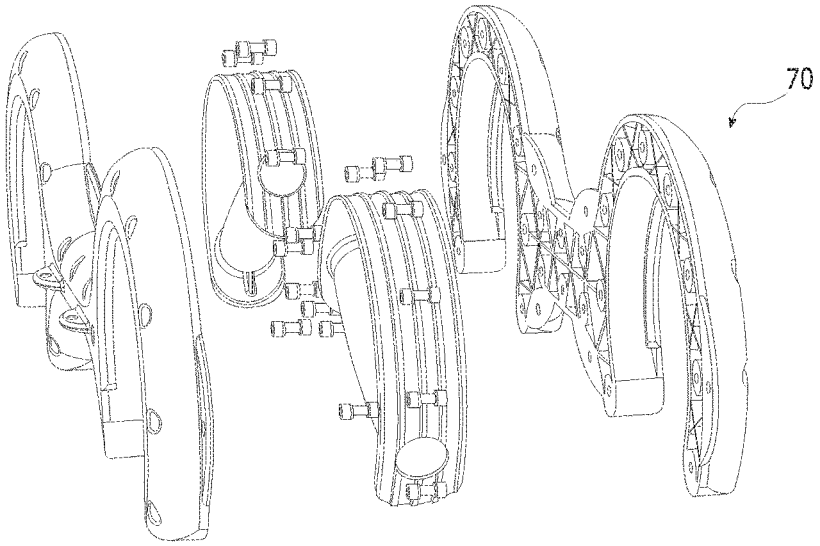
FIG. 9 is a schematic exploded perspective view of the exercise device of FIG. 7

FIGS. 7 to 9 show a second embodiment exercise device 70. In this embodiment the exercise device 70 includes a first and second device track 72, 74, coupled via a central portion 73, which respectively engage a first handle and second handle assembly 76, 78. The first and second handle assemblies 76, 78 are adapted to undergo rotational movement respectively within the first and second device track 72, 74 in the manner discussed above. The exercise device 70 also includes a number of connectors 80 which, unlike the connectors 50 of the exercise device 10, are fixed in numerous positions about the exercise device 70. By securing a resilient body in different positions a user is provided with numerous exercise positions.

The exercise device 70 allows a user to conduct exercises on both sides of the body independently. The rotating handle assemblies 34 allow a user to position their hand grip at different angles to work different parts of the body. Typically, the hand assemblies 76, 78 are adapted for rotation through 360°.

Figure 10:
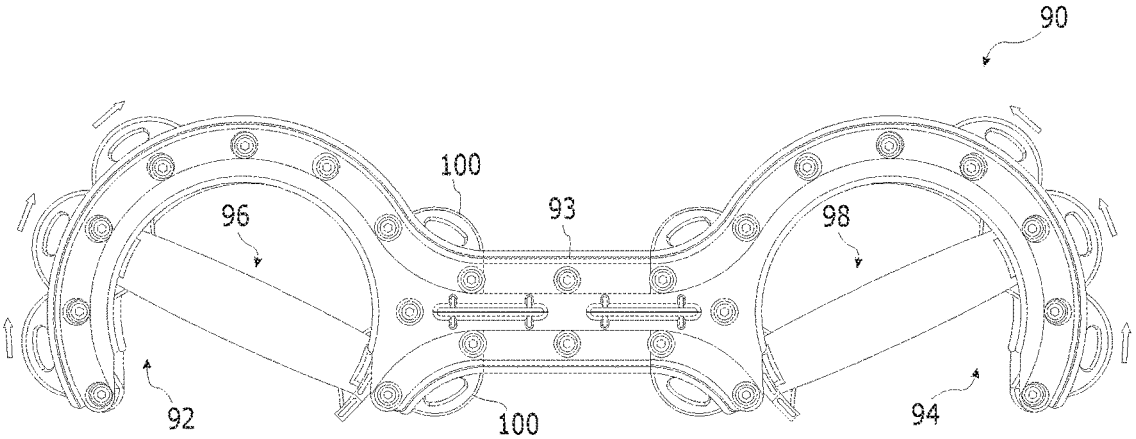
FIG. 10 is a schematic perspective view of a third embodiment exercise device.

FIG. 10 shows a third embodiment exercise device 90. The exercise device 90 is similar to the exercise device 70 in that it includes a first and second device track 92, 94 coupled via a central portion 93, which respectively engage a first handle and second handle assembly 96, 98. The first and second handle assemblies 96, 98 are adapted to undergo rotational movement respectively within the first and second device track 92, 94 as discussed above. The exercise device 70 also includes a number of connectors 100 which are fixed in numerous positions about the exercise device 90. However, unlike the exercise device 70, the exercise device 90 also includes a number of connectors 102 which are able to undergo movement in a manner similar to the connectors 50 of the exercise device 10.

Although the invention has been described with reference to specific examples, it will be appreciated by those skilled in the art that the invention may be embodied in many other forms.

The invention claimed is:

1. An exercise device for strength training, the exercise device including:

a device frame for operative coupling to a load during a strength training exercise, the device frame defining a device track; and a handle assembly for operative attachment to the device frame, the handle assembly including (i) a hand grip to be held by a user during the strength training exercise and (ii) a track follower formation attached to the hand grip, the track follower formation operatively adapted for movement along the device track during the strength training exercise;

wherein the handle grip is elongate and longitudinally extends along a handle grip axis, the handle grip being attached to the track follower formation so as to be adapted for pivotal motion about the handle grip axis;

wherein the device frame defines a curved device track;

wherein the track follower formation is curved as to be complemental to the curved device track;

wherein the handle assembly is adapted to undergo rotational movement as the track follower formation is moved along the device track and includes a device track engagement formation adapted for engaging a complemental handle assembly engagement formation of the device track; and wherein the device track engagement formation includes at least one groove and the handle assembly includes at least one outwardly extending protrusion adapted to be received within the at least one groove.

2. An exercise device according to claim 1, wherein the device frame includes at least one connector for operative coupling to an elongate body.

3. An exercise device according to claim 2, wherein the at least one connector includes a flange having an aperture to facilitate attachment to the elongate body.

4. An exercise device according to claim 3, wherein the device frame includes a plurality of connectors.

5. An exercise device according to claim 1, wherein the device frame includes a first frame member and an opposing second frame member.

6. An exercise device according to claim 5, wherein the first frame member is releasably secured to the second frame member.

7. An exercise device according to claim 6, wherein the first frame member is releasably secured to the second frame member with a plurality of fasteners.

8. An exercise device according to claim 7, wherein each fastener includes a nut and a bolt.

9. An exercise device according to claim 8, wherein the first frame member and the second frame member are of identical construction.

10. An exercise device according to claim 1, wherein the device frame defines a connector track.

11. An exercise device according to claim 10, wherein the connector track includes a connector track base and a connector slot formed within the device frame.

12. An exercise device according to claim 11, wherein a flange is adapted to pass through the connector slot.

13. An exercise device according to claim 12, further comprising at least one connector including a connector body wherein the flange outwardly extends from the connector body, the connector body adapted to be secured between the connector track base and the connector slot with the flange passing through the connector slot, wherein the connector flange is adapted to be moved along the connector slot.

14. An exercise device according to claim 13, wherein the at least one connector is a first connector and the device frame includes two connectors each having a flange, wherein the flange of each connector passes through the connector slot and wherein each connector flange is adapted to be moved along the connector slot.

15. An exercise device according to claim 1, wherein the device frame includes a plurality of connectors.

* * * * *